US011932363B2

(12) United States Patent
Czernik

(10) Patent No.: US 11,932,363 B2
(45) Date of Patent: Mar. 19, 2024

(54) DIVING HARNESS

(71) Applicant: XDEEP SP. Z O.O., Gora (PL)

(72) Inventor: Piotr Czernik, Gora (PL)

(73) Assignee: XDEEP SP. Z O.O., Gora (PL)

( * ) Notice: Subject to any disclaimer, the term of this patent is extended or adjusted under 35 U.S.C. 154(b) by 0 days.

(21) Appl. No.: 17/800,896

(22) PCT Filed: Jan. 5, 2021

(86) PCT No.: PCT/IB2021/050036

§ 371 (c)(1),
(2) Date: Aug. 18, 2022

(87) PCT Pub. No.: WO2021/165752

PCT Pub. Date: Aug. 26, 2021

(65) Prior Publication Data

US 2023/0083750 A1 Mar. 16, 2023

(30) Foreign Application Priority Data

Feb. 19, 2020 (PL) ..... 432946

(51) Int. Cl.
*B63C 11/02* (2006.01)
*B63C 11/30* (2006.01)

(52) U.S. Cl.
CPC ..... *B63C 11/30* (2013.01); *B63C 2011/026* (2013.01)

(58) Field of Classification Search
CPC .... B63C 11/02; B63C 2011/026; B63C 11/30
See application file for complete search history.

(56) References Cited

U.S. PATENT DOCUMENTS 2,141,041 A * 12/1938 Knight ..... B64D 17/30 244/151 R
3,174,664 A * 3/1965 Hue ..... B63C 11/30 224/604
3,957,183 A * 5/1976 Gadberry ..... B63C 11/02 224/628
4,298,149 A * 11/1981 Gottschalk ..... F16M 13/00 224/908
5,329,884 A * 7/1994 Bell ..... A62B 35/0025 119/857
5,348,035 A * 9/1994 Porter ..... A61H 3/02 135/66
5,433,289 A * 7/1995 O'Rourke ..... A62B 35/0031 182/6

(Continued)

*Primary Examiner* — Edwin J Toledo-Duran
(74) *Attorney, Agent, or Firm* — Andrzej Malarz, Esq.

(57) ABSTRACT

A diving harness containing the upper junction connected through the central rail and shoulder straps to the lower junction connected with the hip belt and the crotch strap tied with the buckle, characterized in that the upper junction is permanently connected to the central rail containing at least two layers of textile tapes that are in contact with each other, wherein the textile tape layers are sewn together at regular intervals with back tacks forming through openings between tape layers, wherein the lower junction is permanently connected to at least one mounting bracket, and, wherein the mounting bracket is detachable connected to the central rail via the through opening.

7 Claims, 19 Drawing Sheets

(56) References Cited

Figure 1:
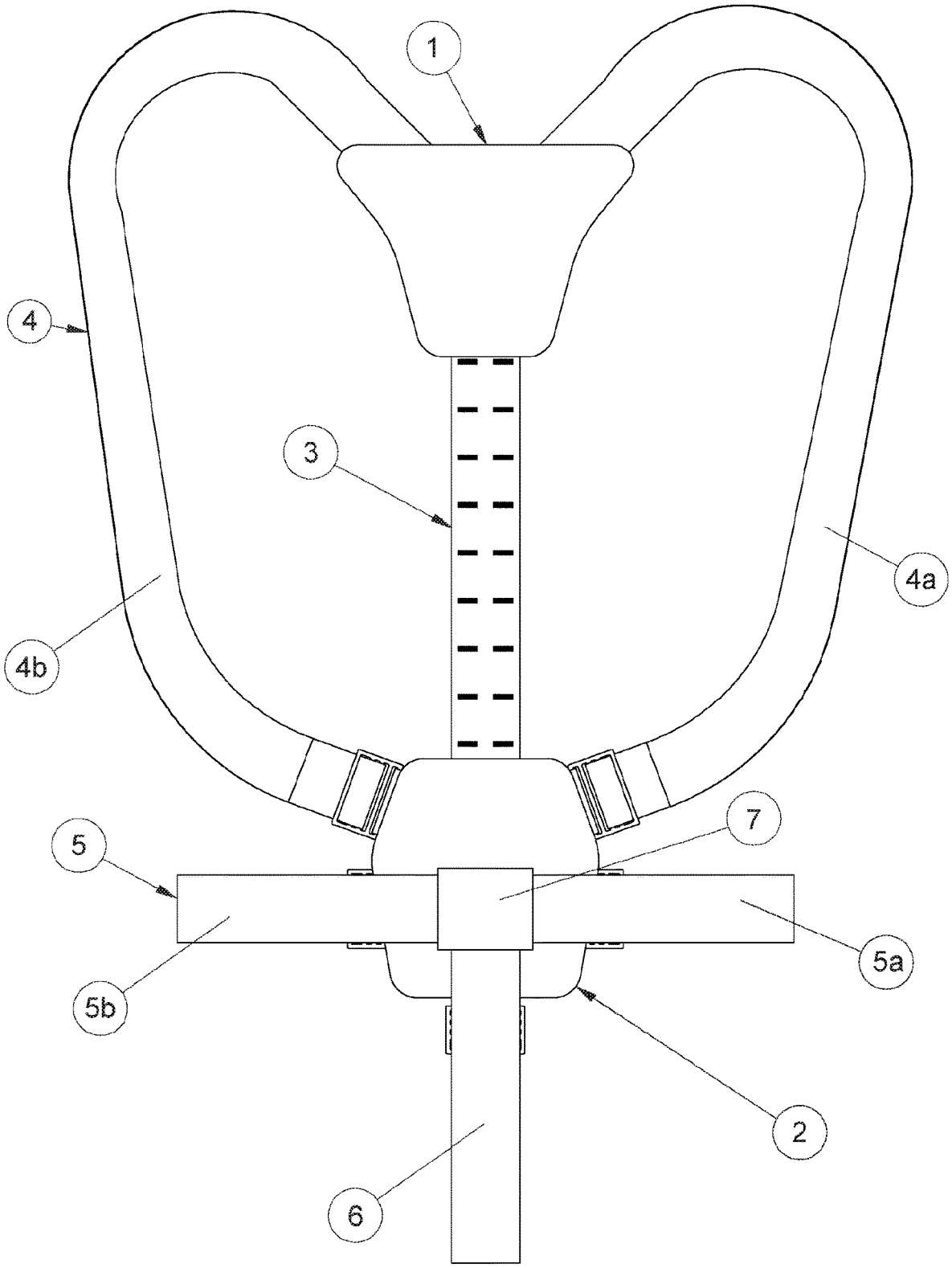

U.S. PATENT DOCUMENTS 5,839,965 A * 11/1998 Mullins ..... A47D 15/006 472/133
D415,013 S * 10/1999 Griffiths ..... D8/354
6,006,700 A * 12/1999 Cox ..... A62B 35/0025 119/857
6,253,874 B1 * 7/2001 Casebolt ..... B64D 17/30 182/6
6,367,582 B1 * 4/2002 Derby ..... A62B 35/0037 182/7
6,412,430 B1 * 7/2002 Johnston ..... B66C 1/18 112/475.08
6,450,131 B1 * 9/2002 Broman ..... A61F 5/026 119/857
6,637,547 B1 * 10/2003 Wydner ..... A41D 13/0007 182/3
6,659,824 B1 * 12/2003 McCormick ..... B63C 9/125 441/106
6,755,594 B1 * 6/2004 Jacoway ..... B63C 11/30 441/106
6,857,820 B2 * 2/2005 Jacoway ..... B63C 11/02 405/187
8,398,337 B2 * 3/2013 Jablonski ..... B63C 11/02 224/660
10,588,361 B2 * 3/2020 Ketterhagen ..... A41D 13/04
10,640,078 B1 * 5/2020 Siegel ..... B60R 22/105
D940,772 S * 1/2022 Shin ..... D15/199
2002/0113105 A1 * 8/2002 Jarman ..... A45F 3/14 224/264
2006/0071435 A1 * 4/2006 Zwack ..... B62B 1/264 280/47.27
2006/0219743 A1 * 10/2006 Gallagher ..... F41C 33/0209 224/587
2011/0016674 A1 * 1/2011 Jablonski ..... A45F 3/10 24/182
2012/0019043 A1 * 1/2012 Merrill ..... B64D 25/06 297/484
2013/0037347 A1 * 2/2013 Wood ..... A62B 35/0025 182/6
2014/0033391 A1 * 2/2014 Doyle ..... A61B 90/53 2/16
2014/0158839 A1 * 6/2014 Doyle ..... A61F 5/013 248/118
2014/0305822 A1 * 10/2014 Kienel ..... B63B 32/87 224/645
2015/0048134 A1 * 2/2015 Fawcett ..... F16M 13/04 224/576
2015/0217150 A1 * 8/2015 Harris ..... A01M 31/02 182/5
2017/0152010 A1 * 6/2017 Angelini ..... A41F 15/002
2017/0238682 A1 * 8/2017 Goryl ..... A45F 3/047
2018/0361565 A1 * 12/2018 Angold ..... B25J 9/106
2021/0170207 A1 * 6/2021 Jain ..... A62B 35/0018
2021/0275190 A1 * 9/2021 Stephens ..... A61B 17/1325
2021/0393049 A1 * 12/2021 Telford ..... A47D 15/006
2022/0104566 A1 * 4/2022 Skalos ..... A61N 1/046
2022/0324545 A1 * 10/2022 Godoy ..... B63C 11/02

* cited by examiner

DIVING HARNESS

It is an object of this invention to provide a diving harness in a sidemount configuration as a part of diving equipment, especially for specialised technical diving in underwater caves, wrecks and structures.

U.S. Pat. No. 6,755,594B1 discloses a known design of diving harness with a backplate used in technical diving with a tank on the back. The steel backplate onto which all equipment pieces, such as a harness, gas tanks or buoyancy compensator, are fixed is the basis of technical diving equipment. Typically, the backplate is an appropriately cut, treated and shaped piece of sheet metal. The backplate due to its considerable weight plays also a role of weight system (ballast). The backplate is attached to the harness which function is to keep the proper placement of the backplate on the diver's back. The harness is equipped with a belt system (shoulder straps, hip belt and crotch strap). The backplate height is usually adjusted by changing the length of shoulder straps.

The sidemount configuration means that the diving equipment, especially diving tanks are placed along the sides of the body instead of on the diver's back. Such arrangement gives a more streamlined silhouette, decreased the drag force under water, and diving regulators are easily accessible and remain under direct control. This configuration was originally used for safe diving in narrow caves, tiny wrecks and everywhere where it was necessary to pass through small siphons, restrictions and crevices. The system allows the diving tank to be attached and disconnected multiple times—as necessary, e.g. for overcoming subsequent obstacles. While overcoming extreme obstacles the diver more often squeezes through than flows freely and therefore it is necessary that the diving harness fits perfectly the diver's body to minimise the risk of catching on protruding obstacles. Also such accessories as battery canisters for flashlights or heated diving drysuits or argon cylinders must be installed so as to protrude as little as possible outside the contour of the body. Recently, the sidemount configuration has found recognition among recreational divers and currently it is more and more often used mainly due to its design solutions enabling any recreational diving.

The first technical problem that occurs in diving in a sidemount configuration is the necessity to fit the harness precisely and as soon as possible to the diver's body. A properly adjusted harness should exactly adhere to the diver's body while not restricting movements.

The harnesses used in a sidemount configuration, especially according to the minimalist, so-called "Mexican school", resemble alpine or climbing harnesses or safety harnesses used for working at height much more than conventional diving harnesses. Such harness designs enabling the strap length to be adjusted are known from a number of patent specifications, for example, Polish patent PL209958B1, United States patents U.S. Pat. No. 5,329,884A and U.S. Pat. No. 7,979,919B2 as well as Chinese patent CN1688366B. However, such designs often highly restrict movements or prevent sufficiently good fitting to the diver's body.

The first problem mentioned above is solved to some extent by the Razor harness[1] developed by Steve Bogaerts. The Razor harness consists of appropriately connected fabric straps. The backplate is replaced with a central/lumbar strap running along the spine, which, by taking an anatomical shape, fits much better to the diver's back than the backplate. The harness allows the distance between the upper and lower junction points by changing the length of the lumbar strap weaved between them.

[1] Source: www.gosidemount.com as of Jan. 18, 2020

This solution was extended, among other things, by the Polish harnesses Eques Side Mount[2] and Xdeep Stealth[3] wherein the length of straps is adjusted with a set of stoppers, adjusters and buckles. In the Xdeep Stealth harness when changing the length of the central strap, the harness should be arranged so that the centre of the harness upper junction is at the height of scapular bones, while the centre of the lower junction is at the waist. After adjusting the harness to the diver's height it is necessary to adjust the length of shoulder, waist/hip and crotch straps. Incorrectly set length of the harness central webbing leads to improper work of the harness during body movements that manifests itself by movement restrictions or harness loosening. Straps work all the time while diving and are subject to various stresses. If the harness is used for a long time, the smallest adjustment requires to exert a high force or to use various tools (e.g. tools for prying the straps jammed in stoppers), thus making this operation highly time-consuming.

[2] Source: www.gosidemount.com.pl as of Jan. 18, 2020

[3] Source: www.xdeep.pl as of Jan. 18, 2020

However, a revolutionary design of the Razor harness revealed another problem, namely how to comfortably distribute the weight with such a minimalist design.

The second technical problem is related to proper trim, i.e. placement of negatively buoyant equipment such as ballast, tanks or torches with respect to positively buoyant equipment such as gas in buoyancy compensator or suit buoyancy. The key to achieve the acceptable trim, thus, stable position in the water is proper weight distribution on the diver with respect to buoyancy forces coming from equipment (compensator, suit). Since in diving the buoyancy of individual components affecting the trim is changed, it is difficult to achieve proper weight distribution on the diver, and normally it requires to do multiple dives to make any necessary corrections.

This problem is resolved by the Polish harnesses with ballast systems mentioned above: Eques Side Mount[4] and Xdeep Stealth[5]. The problem with placing more weight necessary for diving, e.g. in drysuits is resolved by adding the central weight pocket to the harness. The central weight pocked is mounted on the central strap and can be used in addition to or instead of conventional weight pockets mounted to the hip belt. The central weight pocket is threaded through the central strap and bolted to the harness upper junction with a bolt and nut and is bolted also to the lower junction in deigns where it is impossible to adjust its position. The ballast can be placed in one or more pocket parts at different heights to facilitate weighing. The weight transfer between pocket parts is often insufficient and then the central weight pocket (in systems enabling its mounting height to be adjusted) is shifted downwards, thus, allowing the diver's centre of gravity to be established precisely, thus, also better weighing.

[4] Source: www.gosidemount.com.pl as of Jan. 18, 2020

[5] Source: www.xdeep.pl as of Jan. 18, 2020

In the Xdeep Stealth system[6] a change in the central weight pocket mounting height is possible due to the adapter threaded onto the central strap. To dismantle the pocket, the diver is required to use appropriate tools. To mount the adapter it is required the central strap to be unthreaded from the lower junction, mounted on the central strap and then screwed to the weight pocket adapter and, finally, to set the central strap in the appropriate position. This is a time-consuming operation as each

[6] Source: www.xdeep.pl time the whole central strap must be dismantled at each adjustment of the central weight pocket mounting height.

The next problem is the necessity for stable mounting of diving accessories such as battery canisters for flashlights, battery canisters for drysuit heating and drysuit argon cylinder. Accessories should be both easily removable, as this is important, for example, when passing through various restrictions in caves or tiny wrecks, and be fastened securely while swimming in an open space. Obviously, the location of accessories affects weighing, too.

When diving in a sidemount configuration accessories are commonly attached to the central strap with a flexible bungee hoses. Unfortunately, accessories mounted in such a way can move all the time. In addition, under water, after removal when diving through narrow passages it is difficult to reinstall them. There are different types of adapters threaded through harness webbing enabling accessory installation. This solution ensure significantly more stable grip but if it is necessary to change accessory placement, the whole central strap, and sometimes also the central weight pocket must be dismantled.

The purpose of the invention is to provide an improved design of diving harness eliminating the above drawbacks to enable quick fitting to the diver's body without the aid of tools, quickening and facilitating the weighing by changing placement of the ballast and additional diving accessories and facilitating stable mounting of these accessories.

The diving harness containing the upper junction connected through the central rail and shoulder straps to the lower junction connected with the hip strap and the crotch strap tied with buckle, characterised in that the upper junction is permanently connected to the central rail containing at least two layers of textile tapes that are in contact with each other. The textile tape layers sewn together at regular intervals with locking stitches forming through openings between the tape layers. The lower junction is permanently connected to at least one mounting bracket. The mounting bracket is detachably connected to the central rail via the through opening.

The distance between the upper and lower junctions is adjusted by installing the mounting brackets in the central rail through openings placed higher or lower than the diver's body.

Such solution enable the harness to be fitted to the diver's body quickly and precisely without the use of a tool and without dismantling the entire harness. The time needed for proper harness adjustment is much shorter than that required in existing solutions.

It is also advantageous that the diving harness contains the central weight pocket permanently connected to at least two mounting brackets. The brackets are positioned in relation to each other at spacing corresponding to through opening arrangement. The mounting brackets are detachably connected to the central rail via the through openings.

The central weight pocket can be secured to the central rail at any height. Such solution facilitates weighing and allows the position of the central weight pocket to be changed without the use of a tool and without dismantling the entire central rail. The time needed for changing the central weight pocket placement is much shorter than that required for adjustment in existing solutions.

It is also preferable that the diving harness contains an accessory handle consisting of the holder connected to a grasping member permanently fixed to at least one mounting bracket. The mounting bracket is detachably connected to the central rail via the through opening.

Preferably the holder has the shape of an angle section.

Preferably the holder is made of a material enabling it to be sewn on other harness components.

Such solution facilitates the weighing as accessories are firmly fixed in a specified place on the central rail. Such solution allows the position of the central weight pocket to be changed without the use of a tool and without dismantling the entire central rail.

Preferably the mounting bracket can be executed in two variants.

The first variant includes the mounting bracket consisting of a fixing base equipped with the first latch with a through opening, and the second latch with a through opening and a rectangular shape spring inserted into the through opening. The side of the spring is mounted in the through opening of the first latch, while the arms of the spring are installed detachably in the through opening of the second latch. Preferably the fixing base is made of a material enabling it to be sewn on other harness components.

The second variant of the mounting bracket contains a soft fixing base, securing tab and a retaining tape inserted into the through opening. The soft fixing base is connected at one end to the retaining tape and at the opposite end is permanently connected to the securing tab. The bottom surface of the retaining tape is detachably connected to the upper surface of the base, while the bottom surface of the securing tab is detachably connected to the upper surface of the retaining tape. Optionally, the soft fixing base is made of a material enabling it to be sewn on other harness components.

Figure 2:
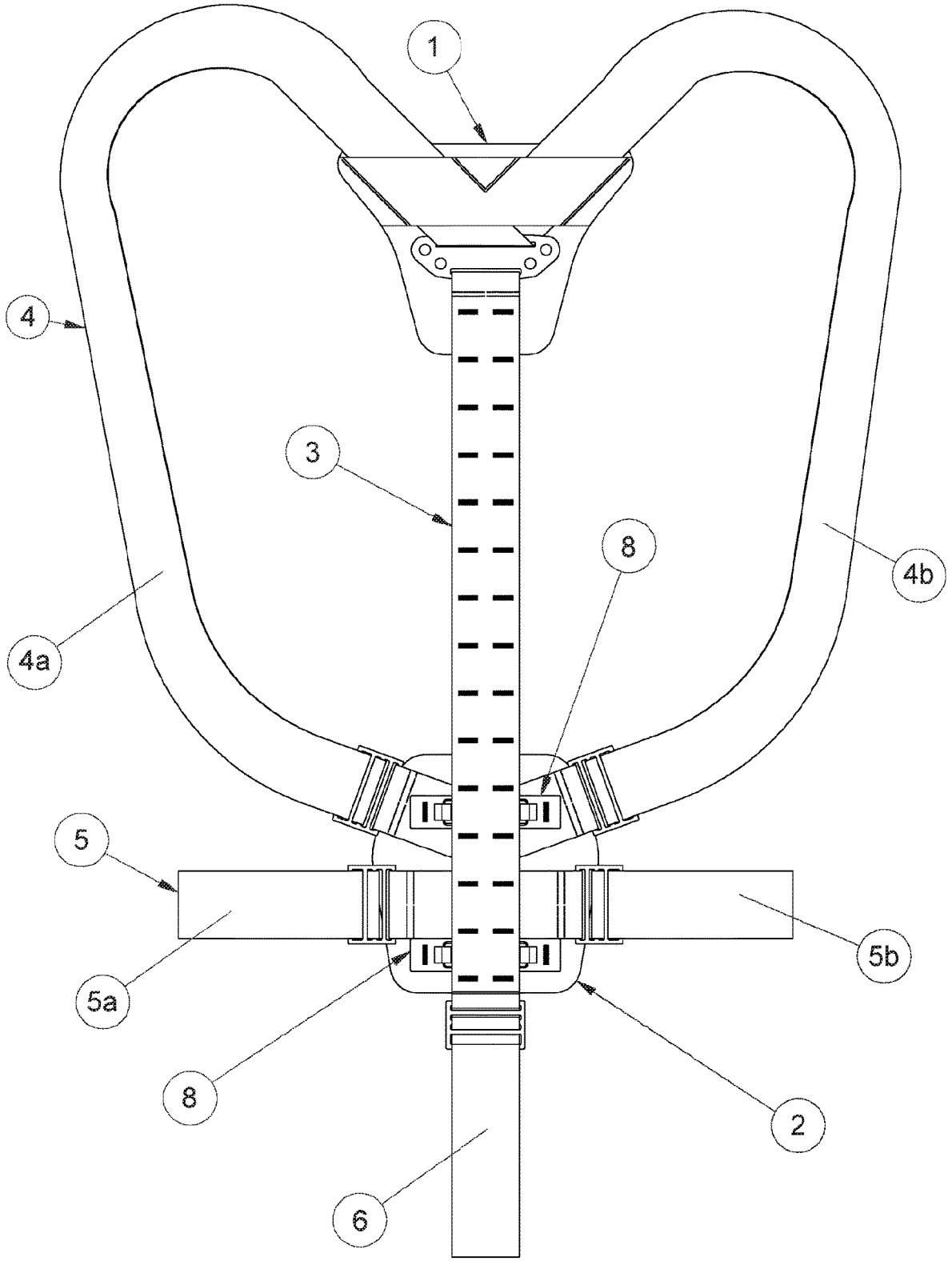
Figure 3:
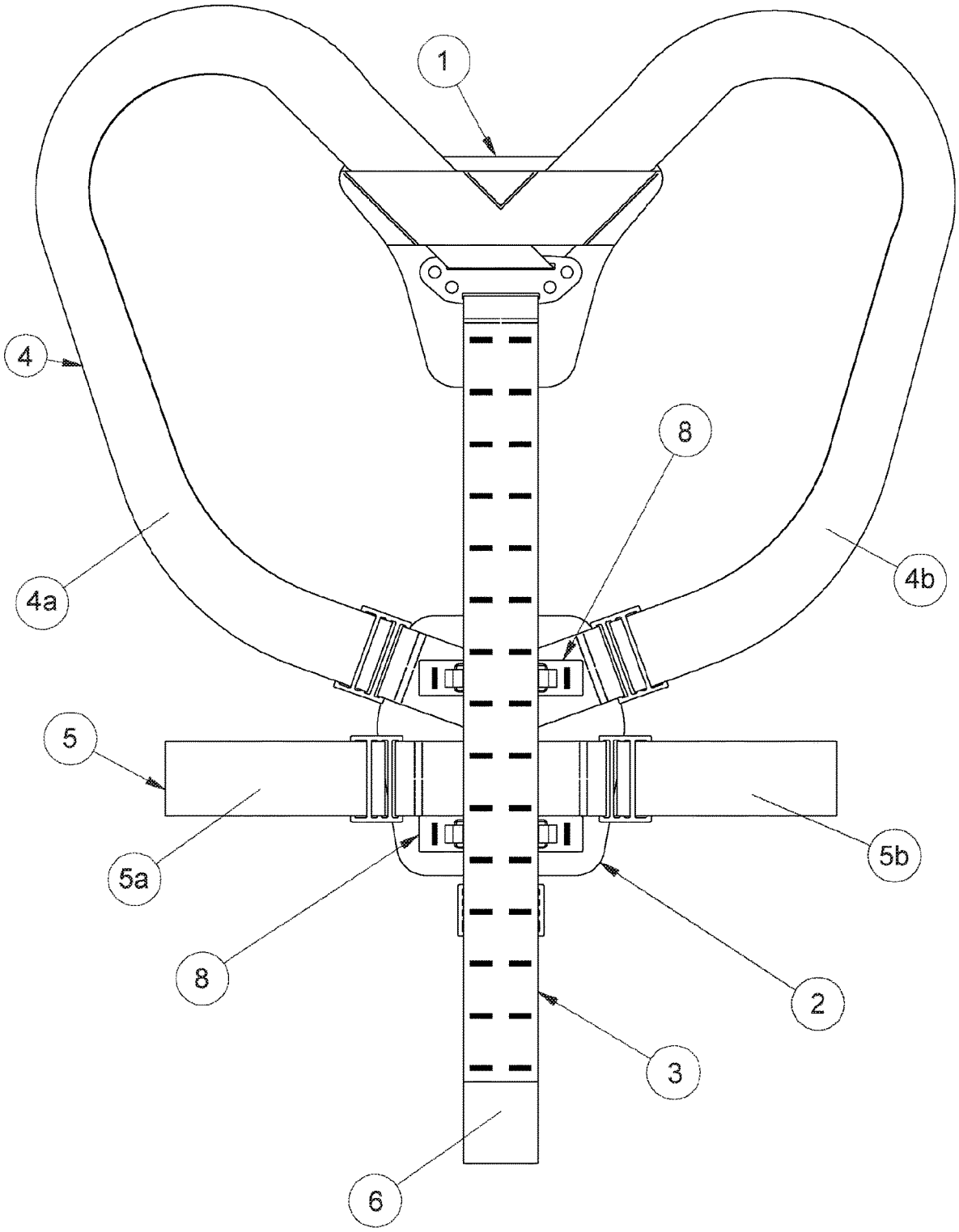
Figure 4:
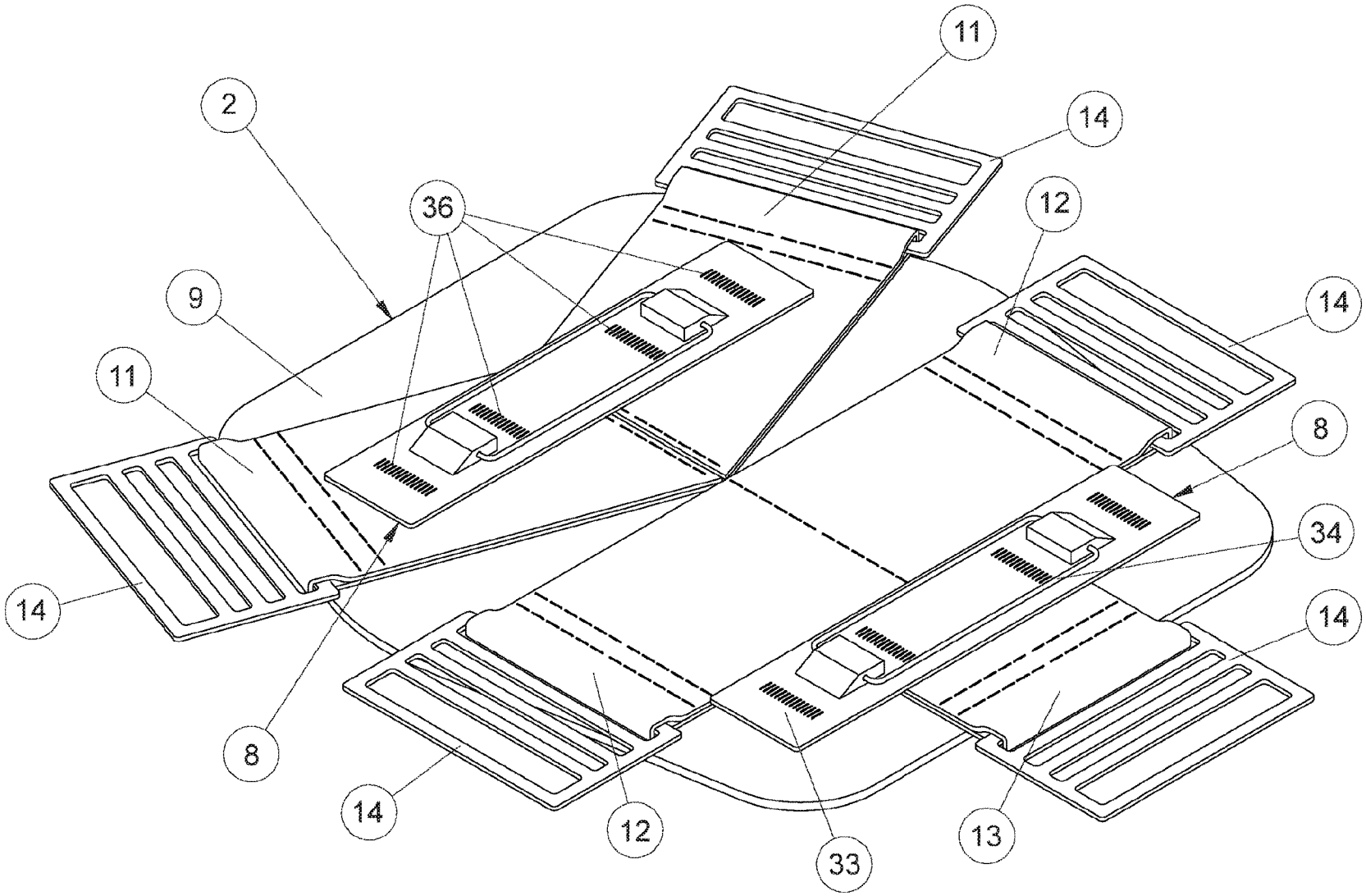
Figure 5:
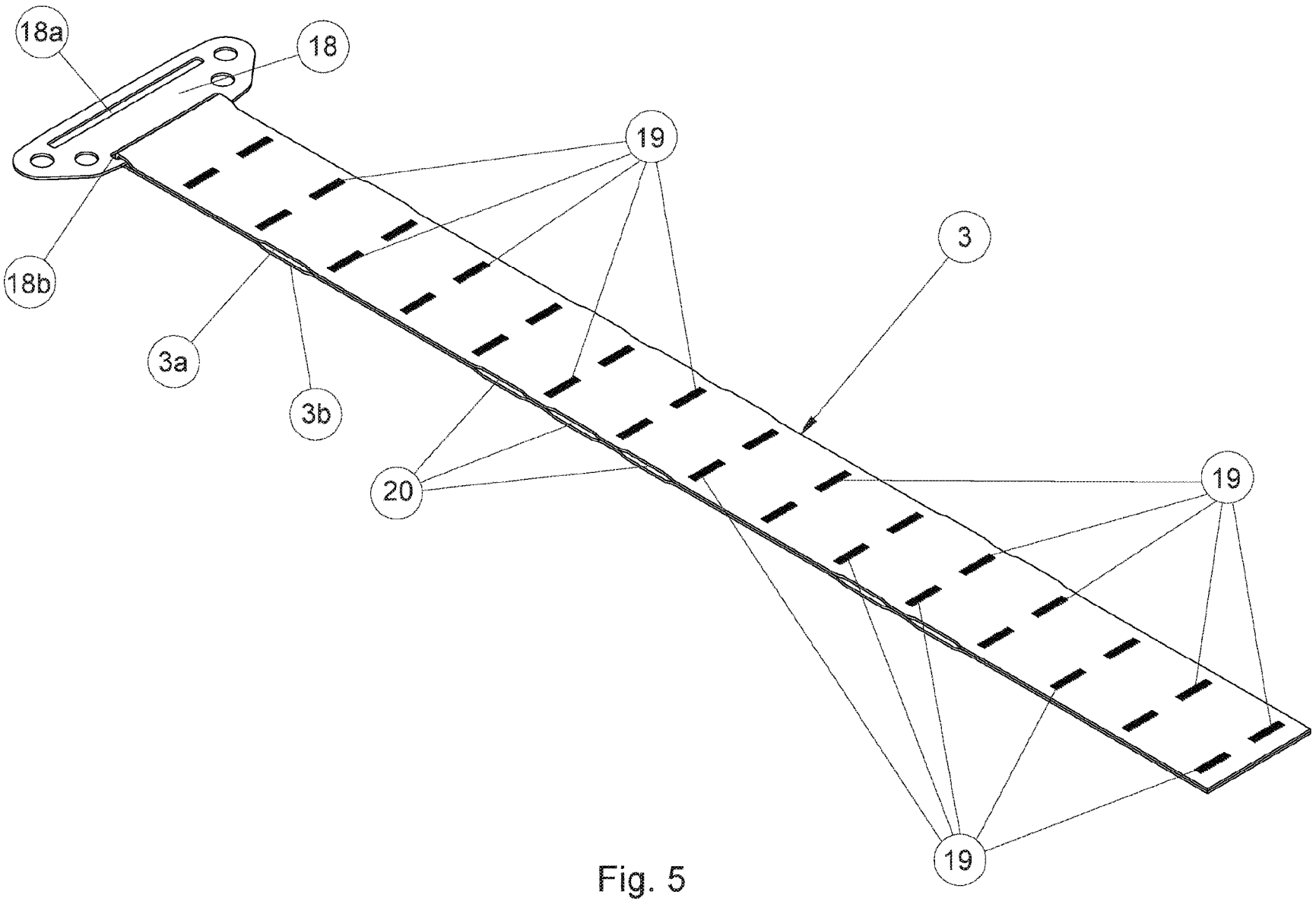
Figure 6:
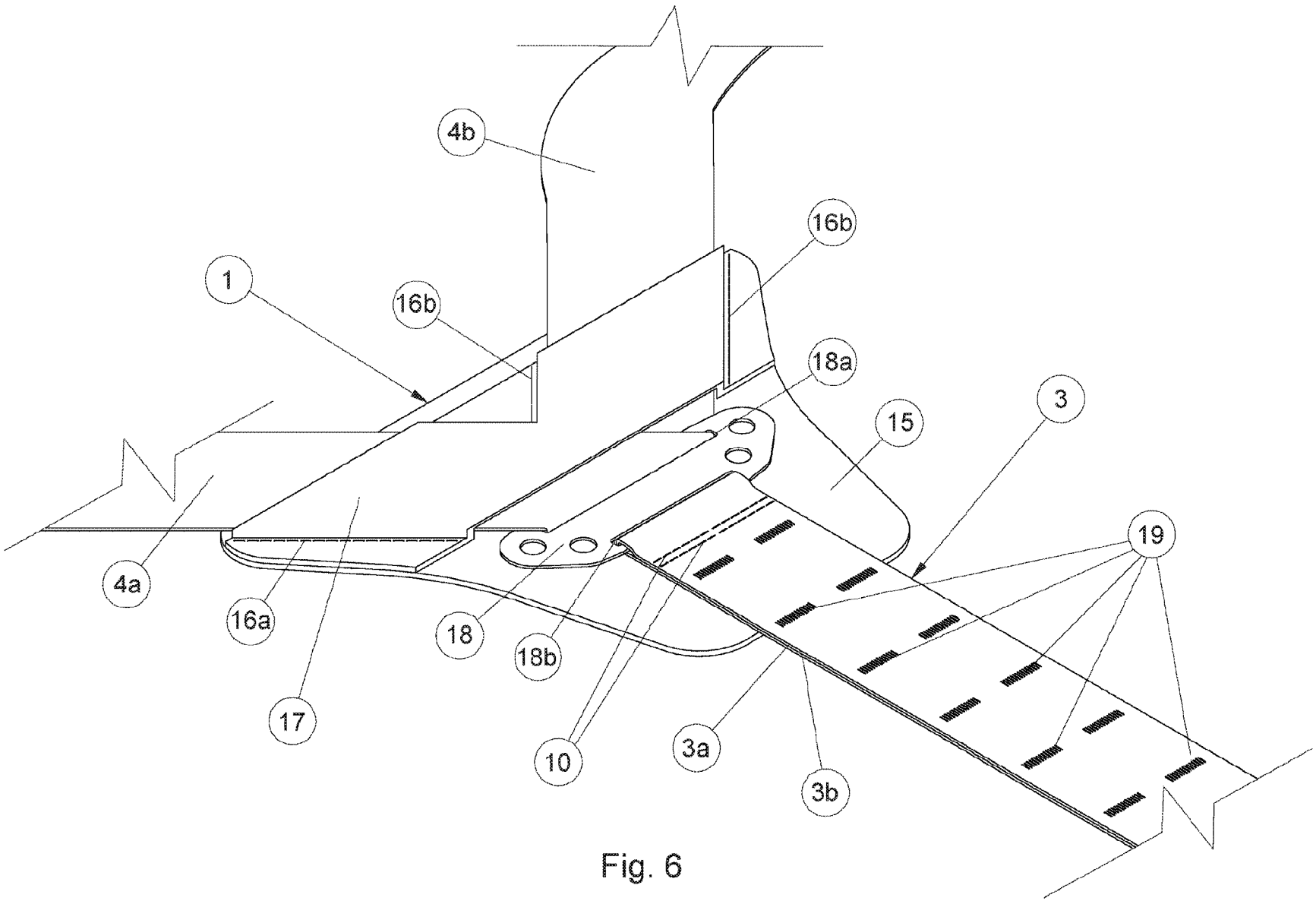
Figure 7:
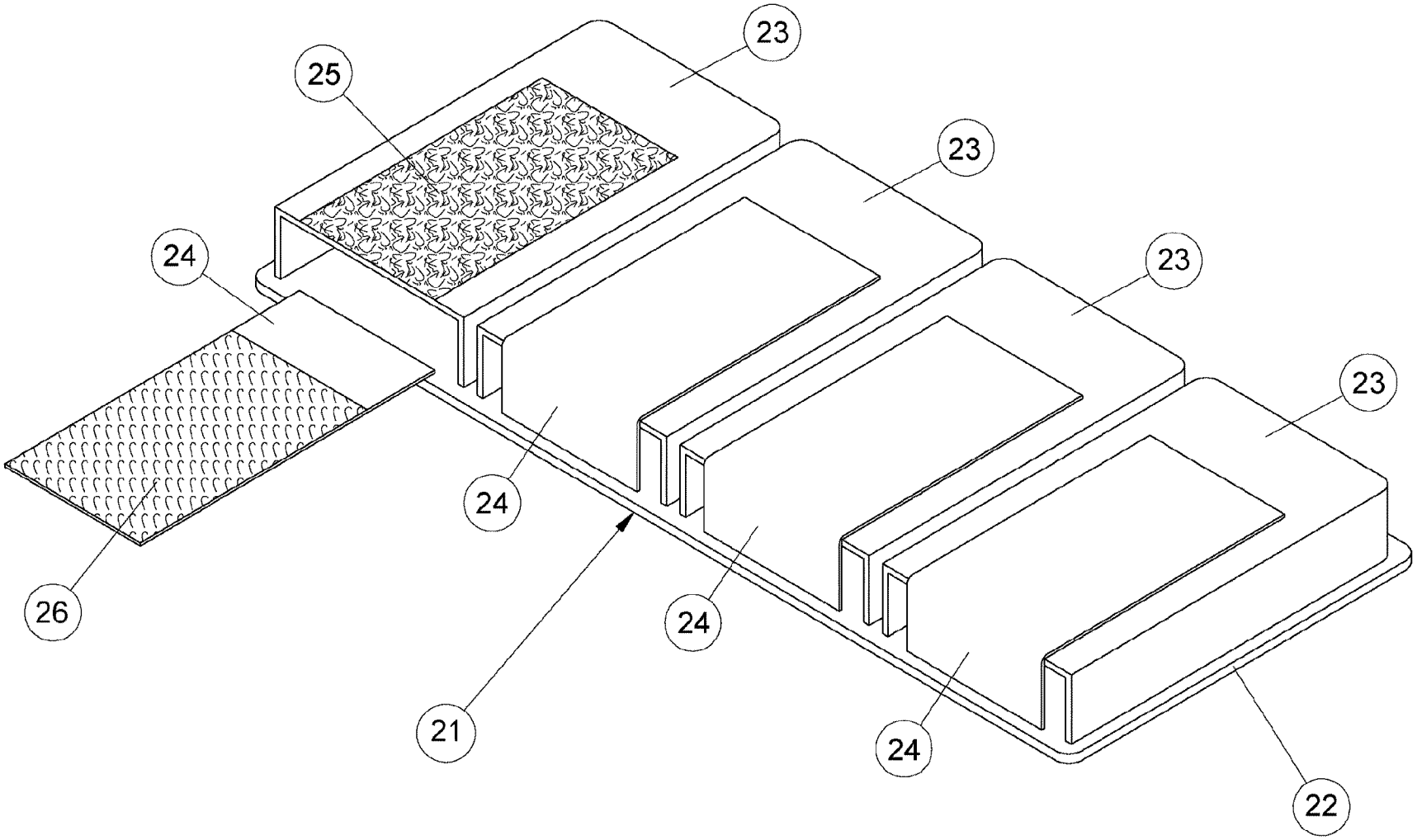
Figure 8:
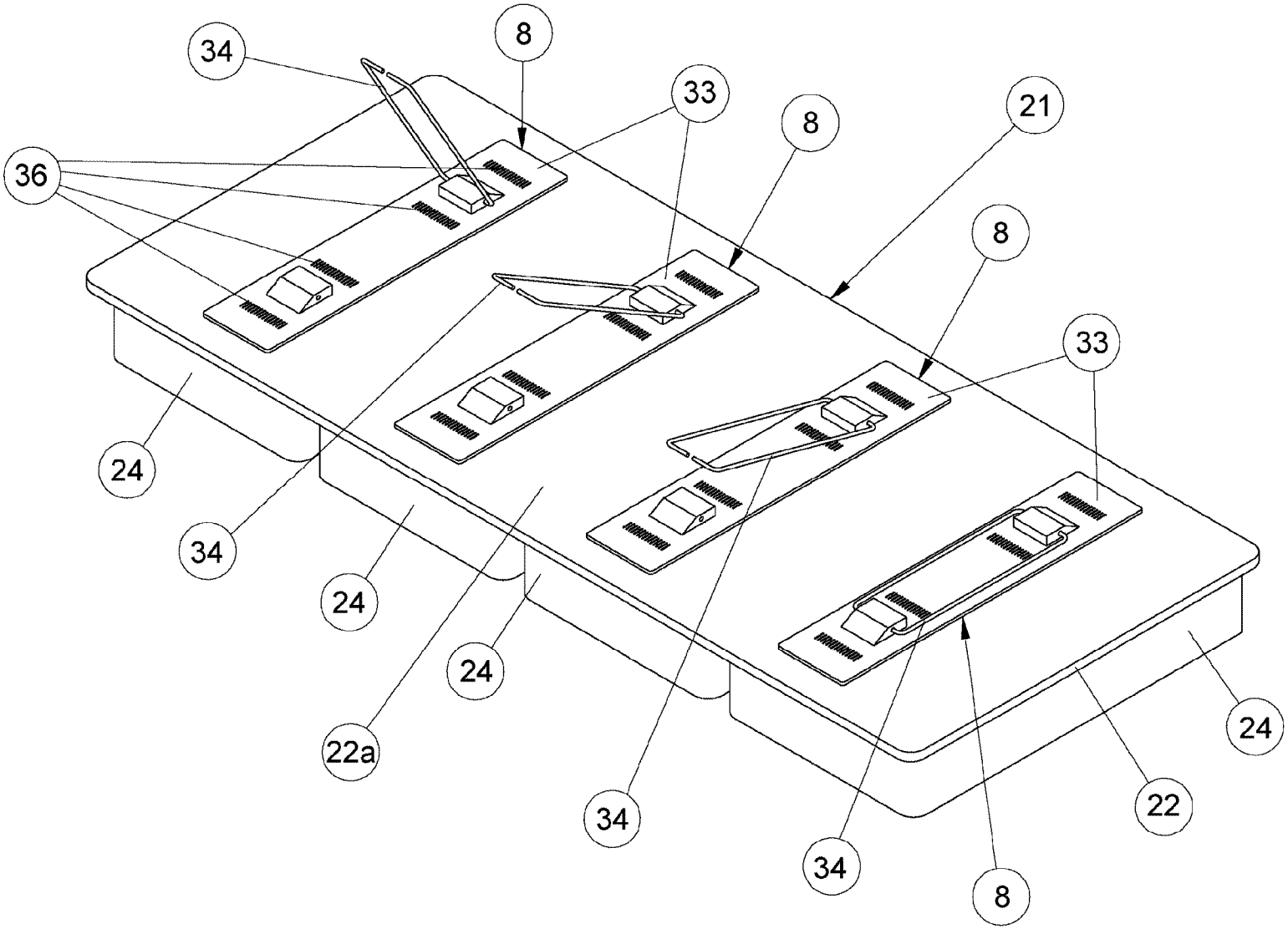
Figure 9:
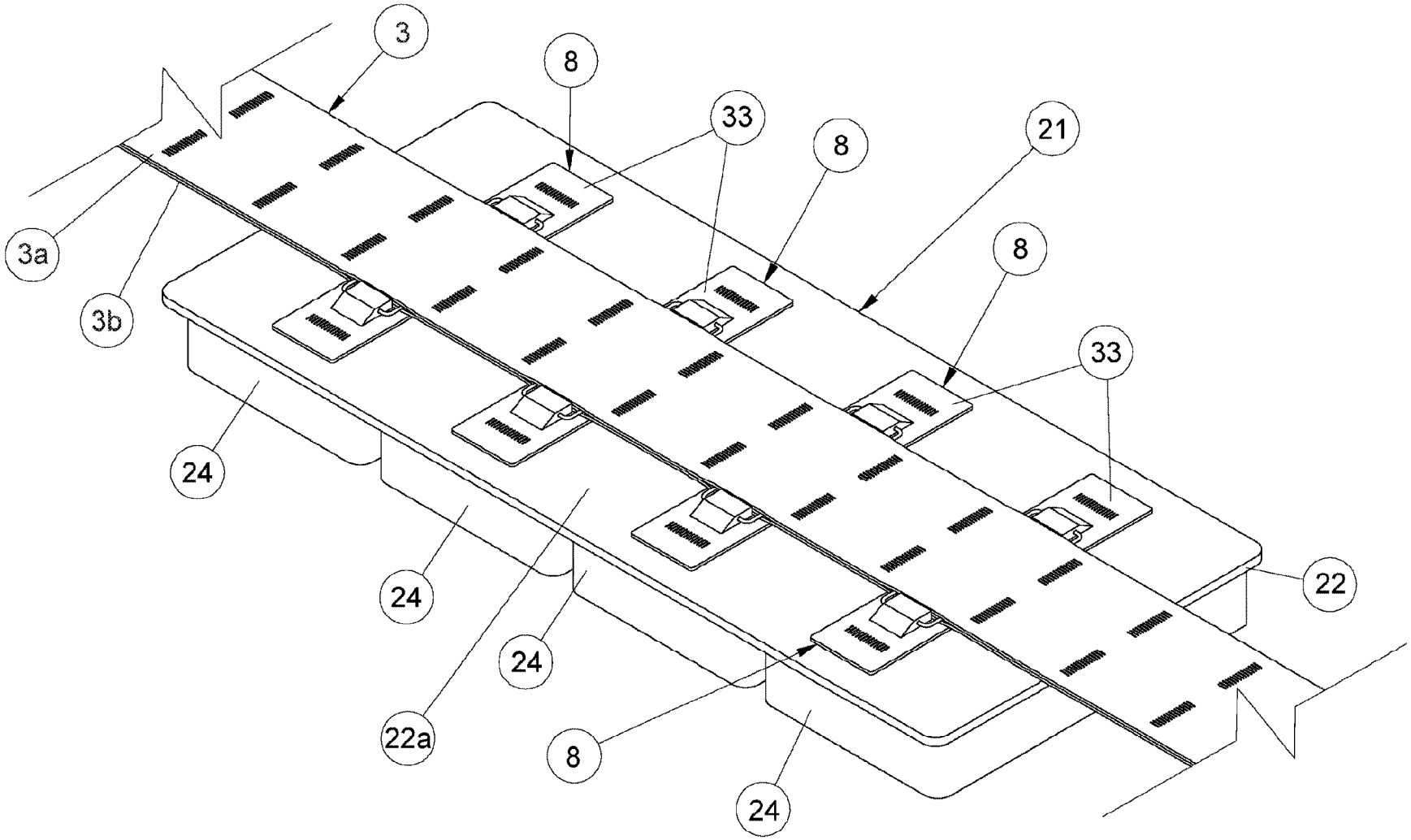
Figure 10:
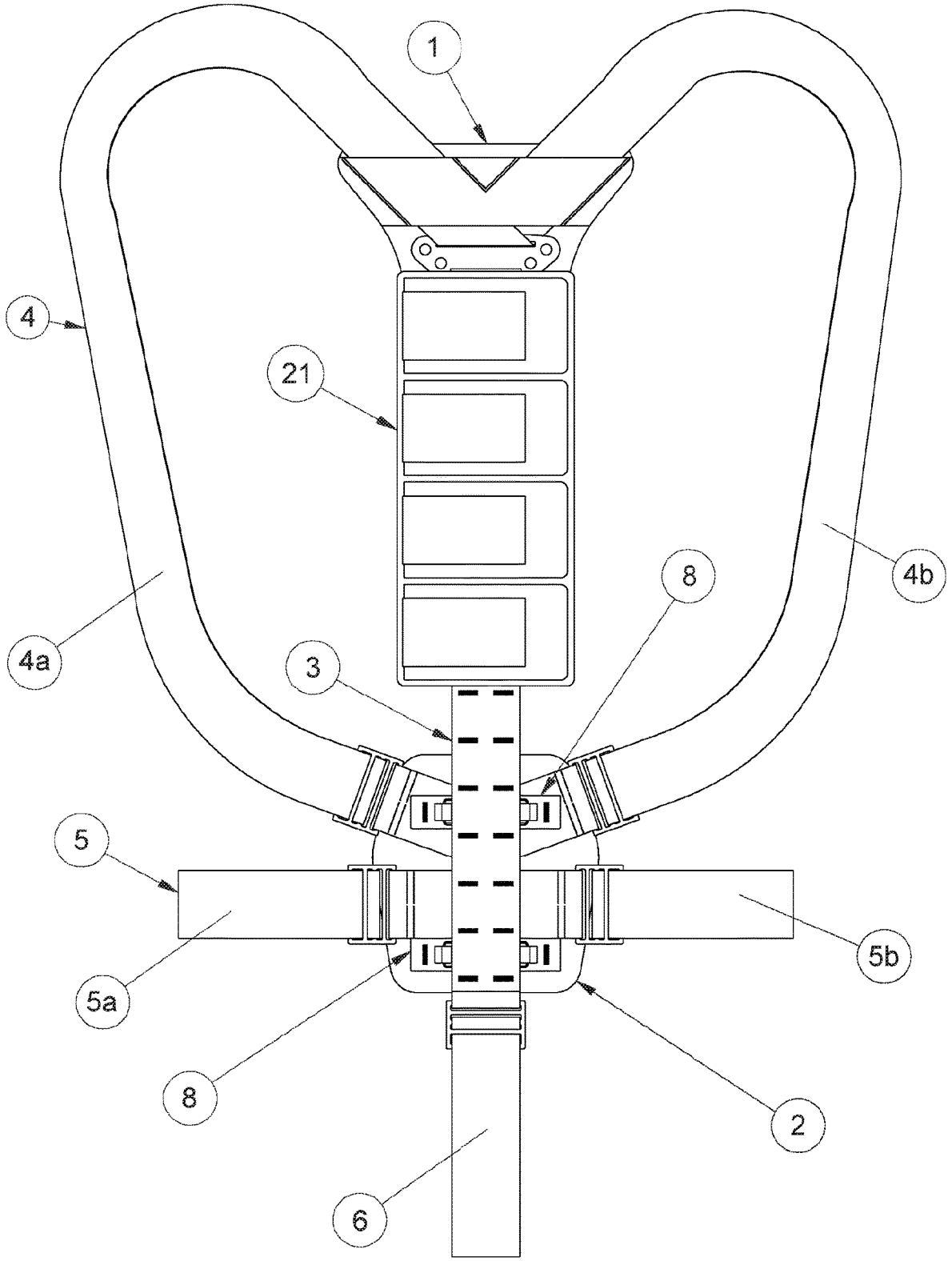
Figure 11:
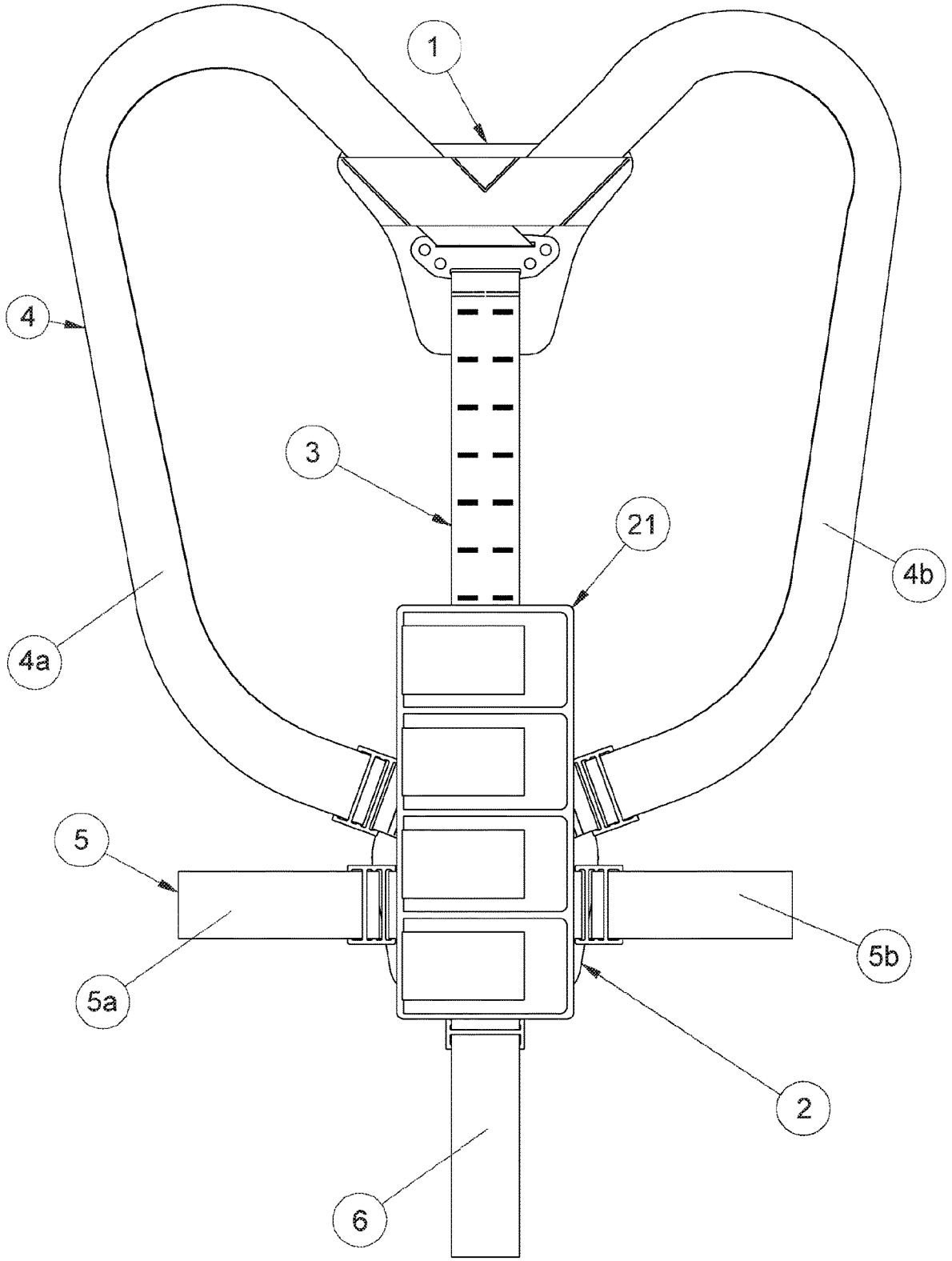
Figure 13:
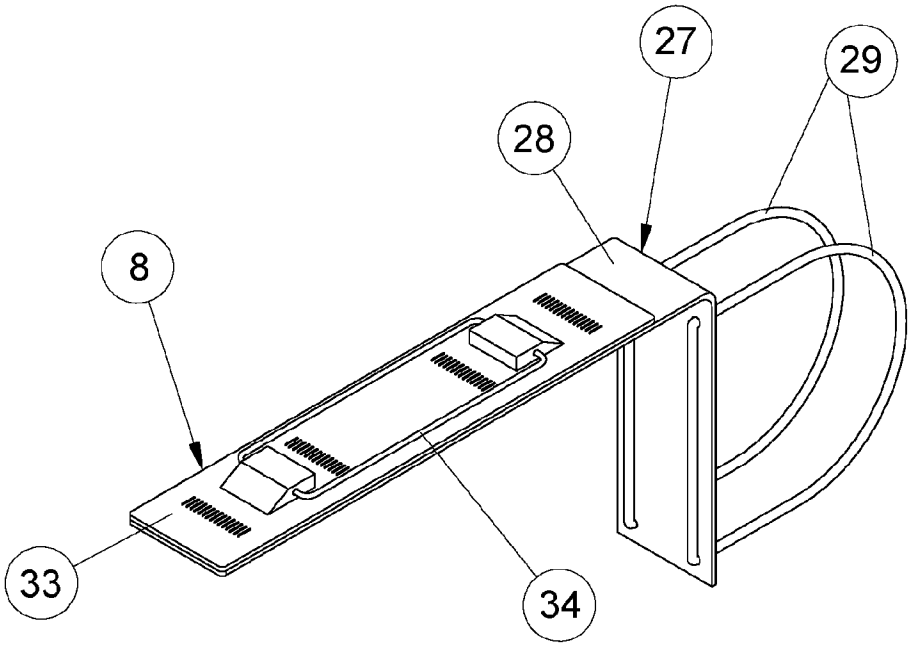
Figure 12:
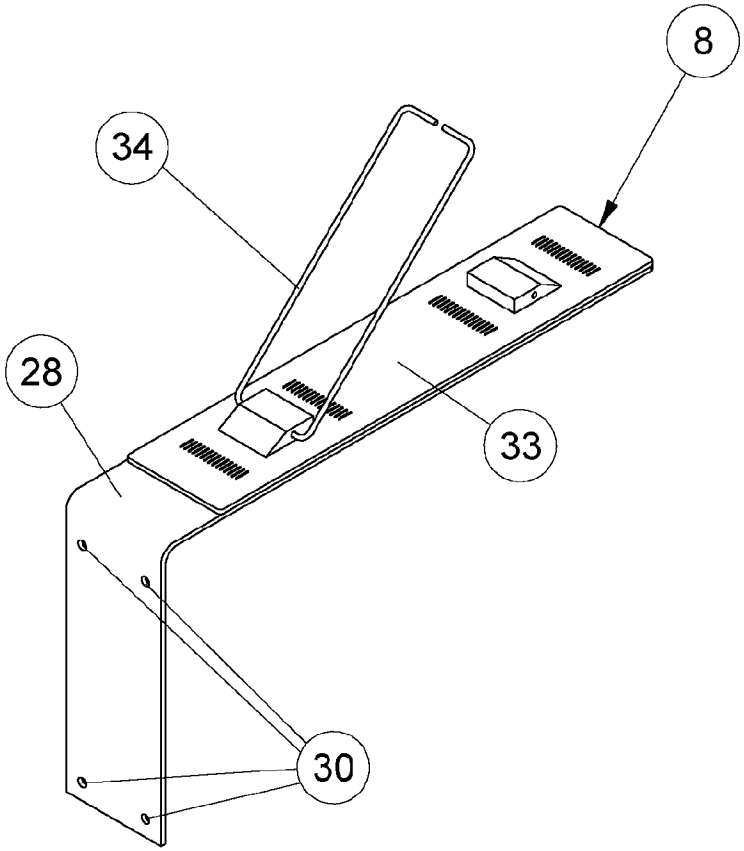
Figure 14:
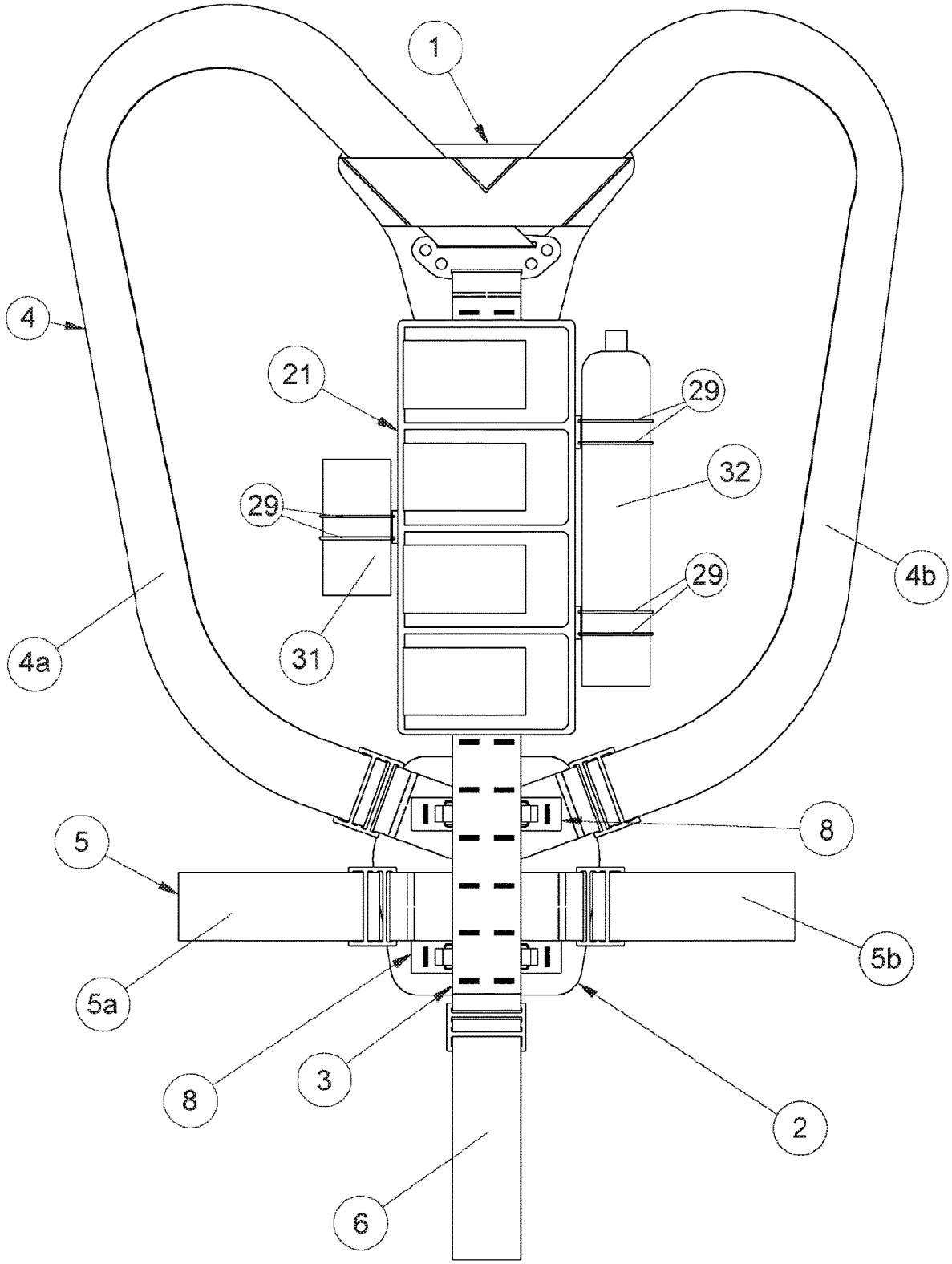
Figure 15:
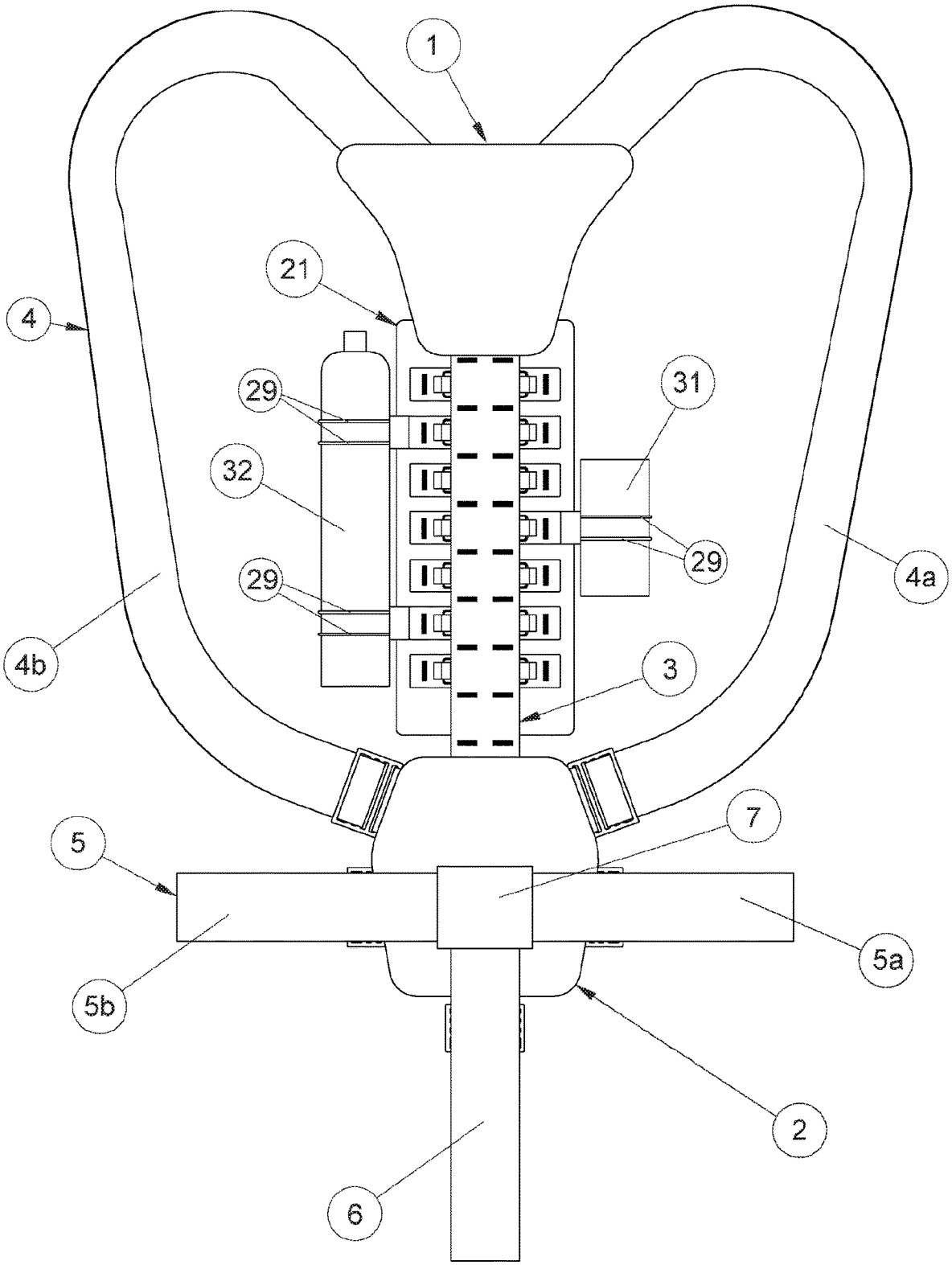
Figure 18:
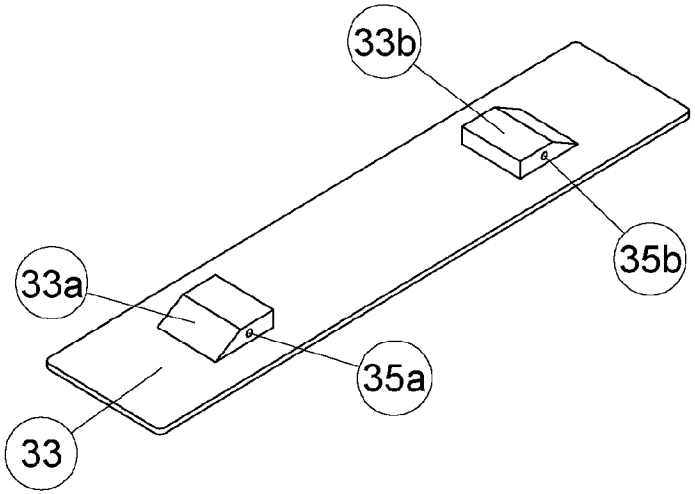
Figure 19:
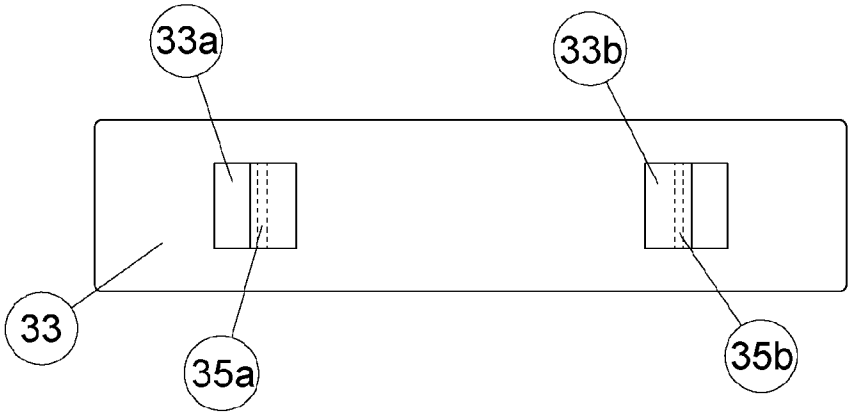
Figure 16:
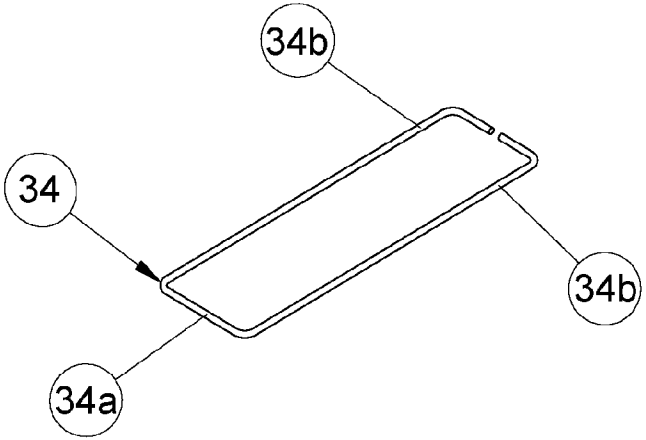
Figure 17:
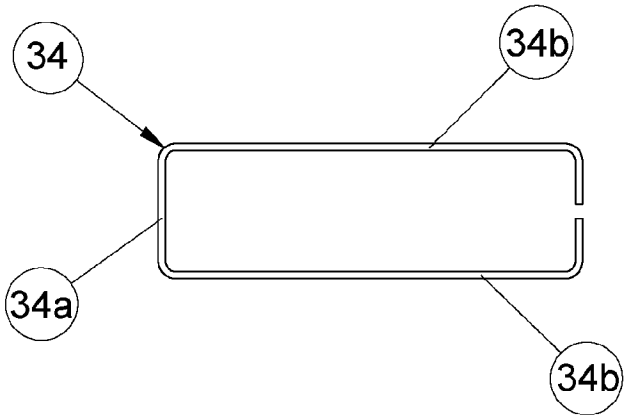
Figure 22:
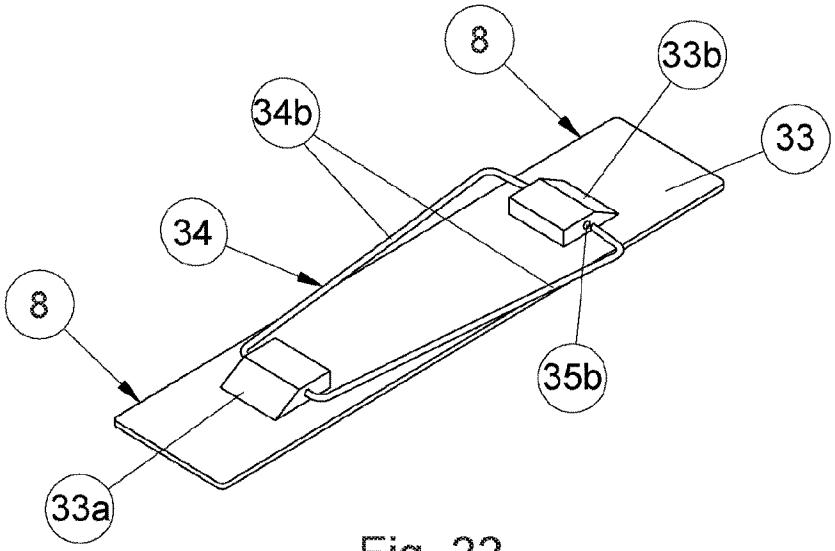
Figure 23:
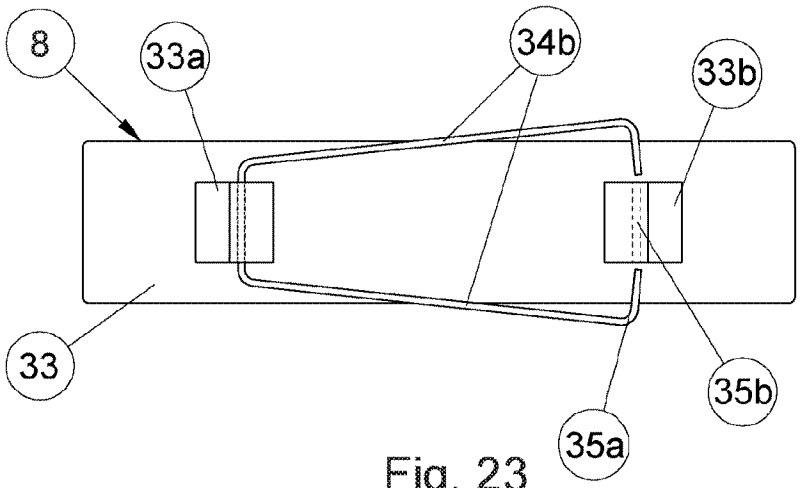
Figure 20:
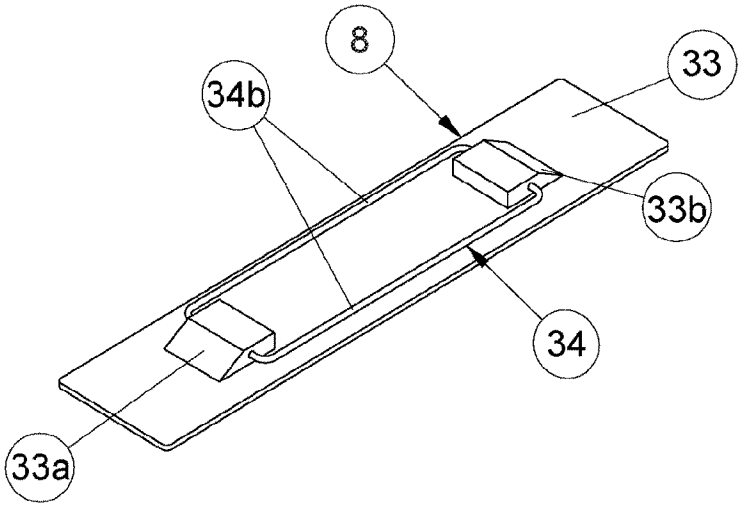
Figure 21:
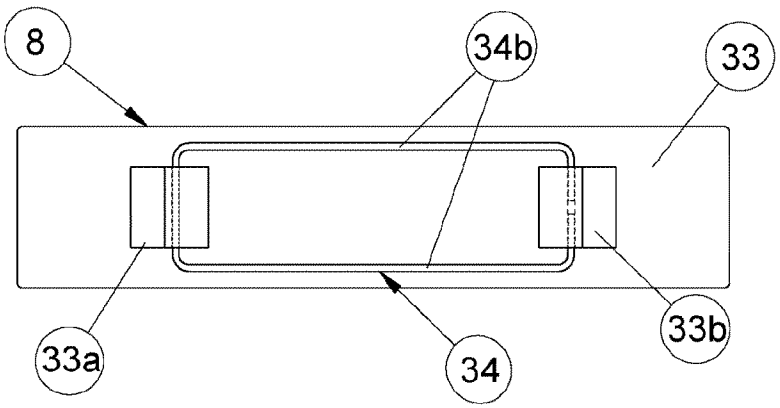
Figure 25:
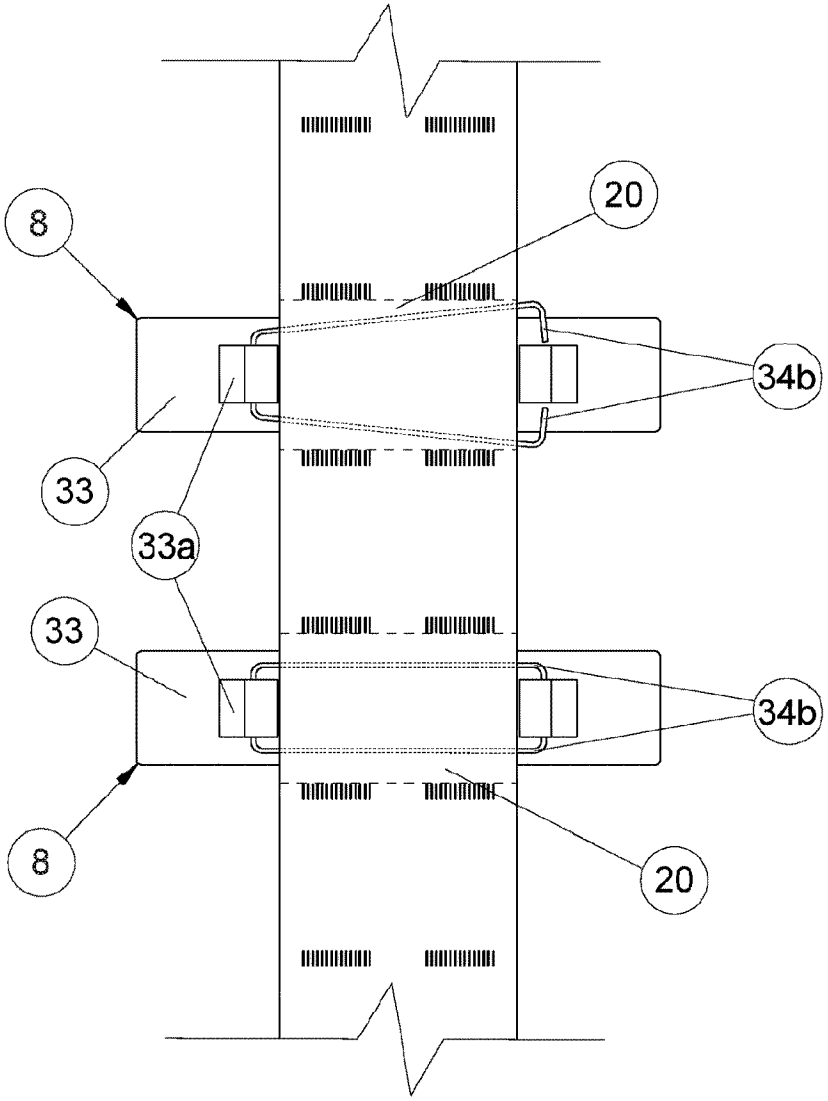
Figure 24:
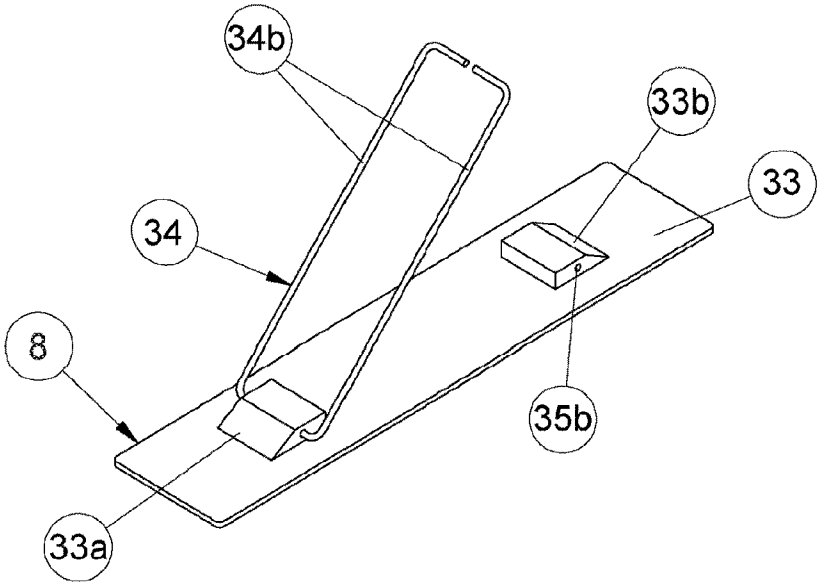
Figure 26:
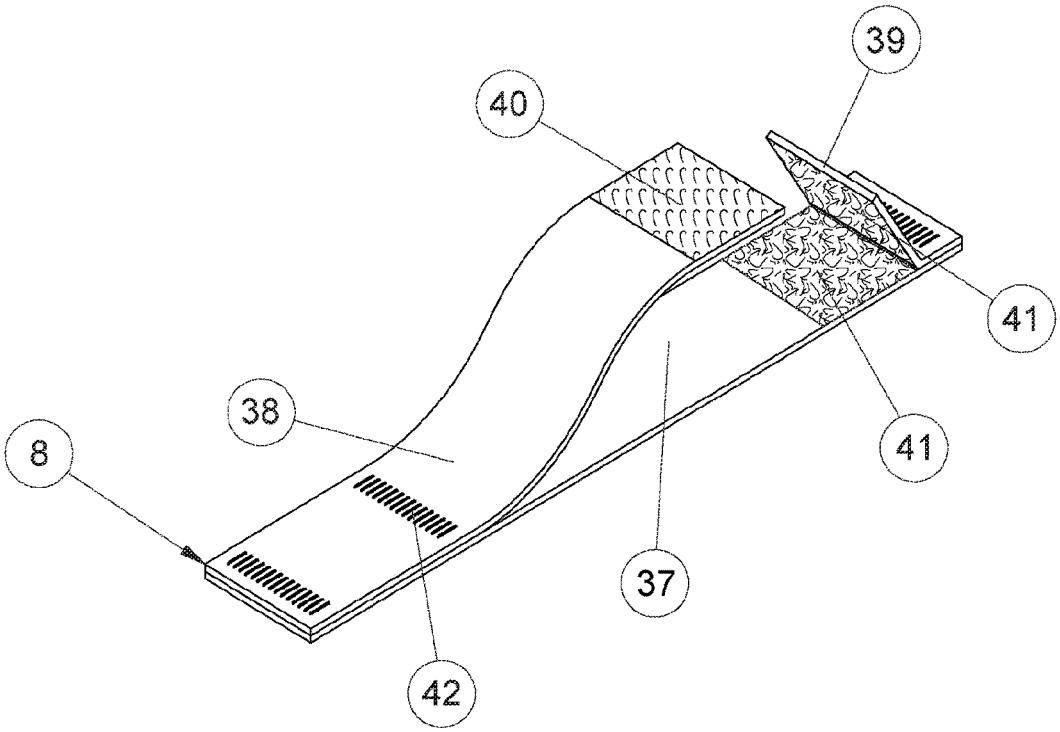
Figure 27:
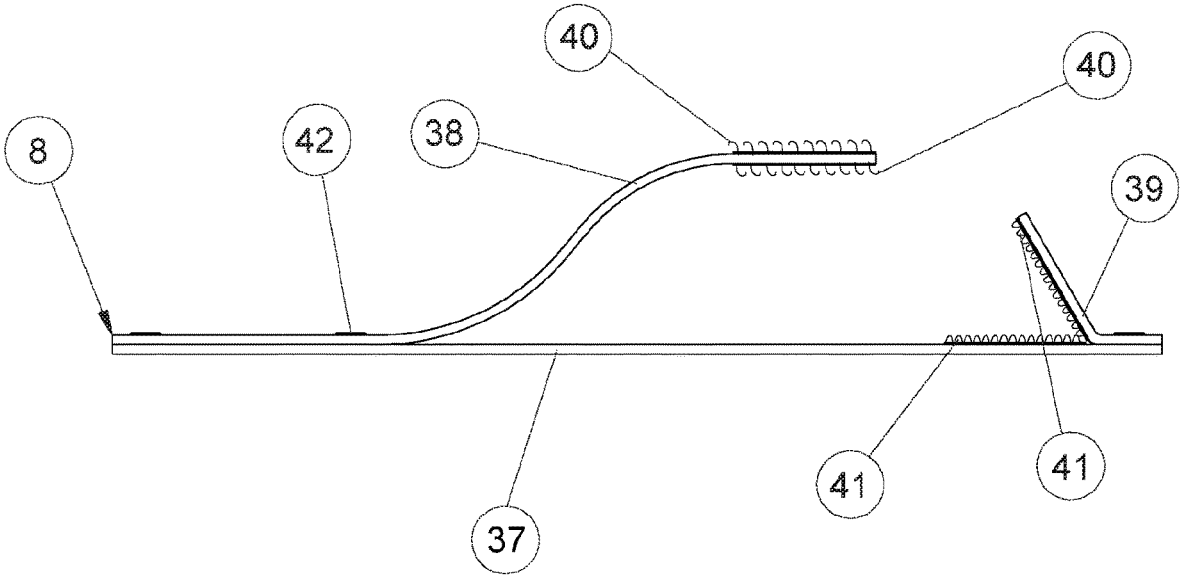
Figure 28:
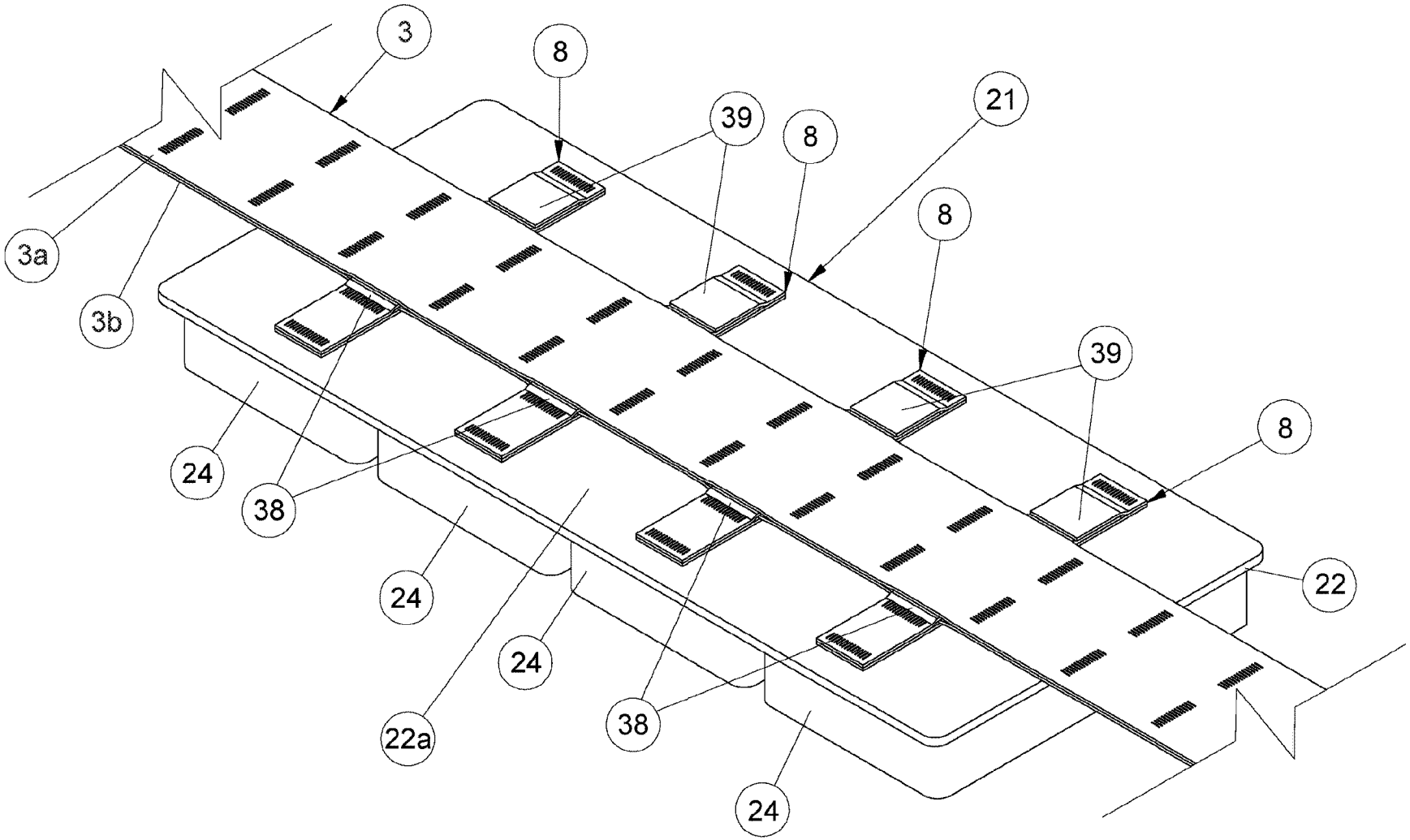

The object of the invention is presented in embodiments in drawings of the diving harness, where:

FIG. 1 presents front view of the diving harness with the lower junction connected at the maximum distance from the upper junction in the first embodiment;

FIG. 2 presents back view of the diving harness with the lower junction connected at the maximum distance from the upper junction in the first embodiment;

FIG. 3 presents back view of the diving harness with the lower junction connected at a smaller distance from the upper junction in the first embodiment;

FIG. 4 presents isometric view of the lower junction of the diving harness with released straps according to the first embodiment;

FIG. 5 presents isometric view of the central rail of the diving harness before sewing to the upper junction according to the first embodiment (to illustrate clearly some openings are shown in the form taken after mounting the mounting brackets);

FIG. 6 presents isometric view of the upper junction of the diving harness with fragments of the shoulder straps and the central rail according to the first embodiment;

FIG. 7 presents isometric view of the central weight pocket of the diving harness from the side of the container according to the first embodiment;

FIG. 8 presents isometric view of the central weight pocket of the diving harness from the side of the mounting brackets according to the first embodiment;

FIG. 9 presents isometric view of the central weight pocket of the diving harness mounted on a fragment of the central strap according to the first embodiment;

FIG. 10 presents back view of the diving harness with the central weight pocket mounted at the maximum upper position according to the first embodiment;

FIG. 11 presents back view of the diving harness with the central weight pocket mounted at the maximum lower position according to the first embodiment;

FIG. 12 presents isometric view of the accessory handle with the mounting bracket of the diving harness according to the first embodiment;

FIG. 13 presents isometric view of the accessory handle according to the first embodiment;

FIG. 14 presents front view of the diving harness with the central weight pocket installed and accessory handles according to the first embodiment;

FIG. 15 presents back view of the diving harness with the central weight pocket installed and accessory handles according to the first embodiment;

FIG. 16 presents isometric view of the mounting bracket spring of the diving harness according to the first embodiment;

FIG. 17 presents top view of the mounting bracket spring of the diving harness according to the first embodiment;

FIG. 18 presents isometric view of the mounting bracket fixing base of the diving harness according to the first embodiment;

FIG. 19 presents top view of the mounting bracket fixing base of the diving harness according to the first embodiment;

FIG. 20 presents isometric view of the mounting bracket with the spring locked in closed position according to the first embodiment;

FIG. 21 presents top view of the mounting bracket with the spring locked in closed position according to the first embodiment;

FIG. 22 presents isometric view of the method for unlocking the spring by extending its arms according to the first embodiment;

FIG. 23 presents top view of the method for unlocking the spring by extending its arms according to the first embodiment;

FIG. 24 presents isometric view of the mounting bracket with the spring tilted at an angle according to the first embodiment;

FIG. 25 presents the mounting brackets in through openings of the central rail—with the spring in locked position, and when the spring is being unlocked inside the through opening according to the first embodiment;

FIG. 26 presents isometric view of the mounting bracket according to the second embodiment;

FIG. 27 presents side view of the mounting bracket according to the second embodiment;

FIG. 28 presents the central weight pocket of the diving harness mounted on a fragment of the central strap according to the second embodiment.

First embodiment

According to the first embodiment of the invention the diving harness contains the upper junction (1), lower junction (2), central rail (3) connecting both junctions and shoulder straps (4) (4*a*) (4*b*), hip belt (5) (5*a*) (5*b*) and crotch strap (6). The hip belt (5) and the crotch strap (6) are fastened with the buckle (7). The central rail (3) is permanently connected to the upper junction (1). The central rail (3) is detachably connected to the upper junction (2) with two mounting brackets (8).

The lower junction (2) comprises the lower padding (9) made of a curl fabric to which connections (11) of the shoulder straps (4) and connections (12) of the hip belt (5) and connection (13) of the crotch strap (6) along with adjusters (14) are sewn together. Each adjuster (14) is placed in a tape folds forming after bending the tape in half before sewing the connections (11, 12, 13). The connections (11, 12, 13) are made of polyamide tape and adjusters (14) are made of stainless steel. The adjusters (14) allow the straps (5, 4, 6) to adjusted and fit to the diver's body and lock at a set length. The left end (5*a*) and right end (5*b*) of the hip belt (5) and one of the ends of the crotch strap (6) are threaded through appropriate adjusters (14) of the connections (12, 13). The second left end (5*a*) of the hip belt (5) is threaded through the stainless steel buckle (7). The metal buckle (7) connects and locks at a set position the free right end (5*b*) of the hip belt (5) and the free end of the crotch strap (6). Two mounting brackets (8) are sewn on the lower junction.

The upper junction (1) comprises the upper padding (15) made of a curl fabric to which the limiter (17) of shoulder straps (4) is sewn with left stitches (16*a*) or right stitches (16*b*). The limiter (17) and shoulder straps (4) are made of polyamide tape.

The tape is threaded between limiters (17) and the upper junction padding (15) along the left stitches (16*a*), and then threaded through the upper opening (19*a*) of the connector (18) and finally threaded between the limiters (17) and the upper junction padding (15) along the right stitches (16*b*), forming two V-shape arranged shoulder straps (4), left (4*a*) and right (4*b*), coming out from the junction (1). The free ends of shoulder straps (4*a*, 4*b*) are threaded through appropriate adjusters (14) of the connections (11).

The central rail (3) is made of polyamide tape folded in half and threaded through the lower opening (18*b*) of the connector (18). The top layer (3*a*) of the central rail (3) is sewn in regular spacing to the bottom layer (3*b*) of the central rail (3) with locking stitches (19). The through opening (20) is the space between two adjacent locking stitches (19) and the top layer (3*a*) and bottom layer (3*b*) of the central rail (3). The distance between the locking stitches (19) is selected so that two mounting brackets (8) turned around the central rail (3) by 180° can be installed in the through opening (20).

In this embodiment the distance between the centres of adjacent through openings (20) is 35 mm. The locking stitches (19) are 2 mm in width. When the top layer (3*a*) and bottom layer (3*b*) of the central rail (3) contact with each other, the through opening (20) is 33 mm in width. The central rail (3) is sewn on the upper junction (1) with connecting stitches (10). The central rail (3) is detachably connected to the lower junction (2) with two mounting brackets (8), which bases (33) are sawn to the lower junction (2). The spacing between brackets (8) corresponds to through openings (20). In the embodiment the central distance between the mounting brackets (8) sewn on the lower junction (2) is 70 mm.

The distance between the upper (1) and lower (2) junctions is adjusted by installing the mounting brackets in the central rail through openings (20) placed higher or lower than the diver's body.

Properly adjusted diving harness adheres perfectly to the diver's body. The centre of the harness upper junction (1) is at the height of scapular bones. The centre of the harness lower junction (2) is at the waist. The central rail (3) runs along the spine.

Such solution enable the harness to be fitted to the diver's body quickly and precisely without the use of a tool and without dismantling the entire harness. The time needed for proper harness adjustment is much shorter than that required in existing solutions.

The central weight pocket (21) contains the base (22) and four weight pockets (23) sewn on it. The weight pockets (23) are closed with closures (24). The Velcro loop tape (25) is sewn on the weight pockets (23) and to close the closures (24) the hook tape (26) is used. Closures (24) protect lead weights (not shown in the picture) placed in pockets (23) against falling out. Both the pocket base (22) and weight pockets (23) are made of a stiff curl fabric. The weight pocket (24) closures are made of polyamide tape.

Four mounting brackets (8) are sewn on the bottom side (22*a*) of the pocket (22) at spacing corresponding to the arrangement of through openings (20). According to the embodiment the central distance between the adjacent mounting brackets (8) sewn on the central weight pocket (21) is 70 mm.

The mounting brackets (8) enable the central weight pocket (21) to be detachably connected to the central rail (3). The distance at which the central weight pocket (21) is placed can be changed by installing the mounting brackets (8) in the central rail through openings (20) placed higher or lower than the diver's body.

Since the mounting brackets (8) are sewn on the central weight pocket (3) turned by 180° along the central rail (3) with respect to the mounting brackets (8) sewn on the lower junction (2), it is possible to install the weight pocket (21) at any height even if through openings (20) are occupied by the mounting brackets (8) of the lower junction (2).

Perfect weighing is possible by establishing precise location of the centre of gravity. This is due to the fact that the central weight pocket (21) can be placed at any height along the central rail (3) located at the diver's body centreline, while lead ballast is placed in one of pockets (23).

Such solution facilitates the weighing and allows the position of the central weight pocket to be changed without use of a tool and without dismantling the entire central rail. The time needed for changing the central weight pocket placement is much shorter than that required for adjustment in existing solutions.

The accessory handle (27) consists of the bracket (28) with the shape of non-isosceles angle section connected to the grasping member (29). The bracket (28) is made of plastic enabling sewing it on the harness textile components or sewing the mounting bracket (8) on it. According to the embodiment, the grasping member (29) there are bungee ropes threaded through opening (30) made in the shorter side of the bracket (28). The mounting bracket (8) is sewn on the longer side of the bracket (28). The accessory handle (27) is detachably connected to the central rail (3) via the mounting bracket (8).

The length of the longer side of the bracket (28) and the place where the mounting bracket (8) is sewn are selected so that the installed mounting bracket (27) does not collide with the central weight pocket (21). The design of the accessory handle (27) allows optional components such as flashlights battery canister (31), argon cylinder (32) or drysuit battery canister to be installed either on the left or right side of the central rail (3). According to this embodiment the flashlights battery canister (31) is installed on the left side of the central rail (3) with one accessory handle (27), while argon cylinder (32) for supplying drysuit is mounted with two accessory handles (27) on the right side of the central rail (3). Such solution facilitates the weighing as accessories are firmly fixed in a specified place on the central rail. Such solution allows the position of the central weight pocket to be changed without the use of a tool and without dismantling the entire central rail.

In the embodiment above the mounting bracket (8) is made as in the first variant. The mounting bracket (8) according the first embodiment comprises the fixing base (33) fitted with two latches (33*a*, 33*b*) and spring (34). The fixing base (33) is made of plastic enabling it to be sewn on harness textile components. The distance between the first latch (33*a*) and the second latch (33*b*) is selected in such a way so that excessive lateral movement of the central rail (3) is limited. Latches (33*a*, 33*b*) are provided with through openings (35, 35*a*, 35*b*). The spring (34) is a rectangular shape spring made of a spring wire. The symmetric cut on one of short sides forms arms (34*b*). The spring arms (34*b*) of the spring (34) after extension return to its original position. The spring (34) can tilt to the fixing base (33) in as axis being its short side (34*a*) fixed in the through opening (35*a*) in the first latch (33*a*).

The spring (34) is locked in closed position by extending the arms (34*b*) and then inserting them in the through opening (35*b*) of the second latch (35*b*).

The spring (34) is unlocked to its open position by extending the arms (34*b*) and then sliding them out the through opening (35*b*) of the second latch (35*b*).

Locking and unlocking the spring (34) in the through opening (20) is possible only due to the fact that the distance between extended arms (34*b*) is shorter than the width of the through opening (20). In this embodiment the width is 30 mm. The installation of the mounting bracket (8) on the central rail (3) consists in unlocking the spring (34) to its open position, inserting the spring (34) into the through opening (20), and then locking the spring (34) in its closed position.

The width of the spring (34) is selected so that two springs (34) of two mounting brackets (8) turned around the central rail (3) by 180° can be installed in the through opening (20) of the central rail (3) at the same time. In this embodiment the spring width is 20 mm. The width of the spring (3) is less than the width of the through opening (20). This allows the spring (34) to move inside the through opening (20) in longitudinal direction of the central rail (3). Such movement is desired and thanks to it the central rail (3) still remains flexible and well adheres to the diver's body after a lot of mounting brackets (8) are installed on it.

An additional advantage of the mounting bracket (8) according to the first embodiment is that forces acting on the central weight pocket (20) in diving always press one of the arm (34*b*) of the spring (34) to the latch (33*b*). In the first embodiment all mounting brackets (8) are connected to other harness components with 4 fixing stitches (36).

Second Embodiment

The second embodiment is analogous to the first one, except for the mounting bracket (8) that is made as in the second variant.

In the second embodiment the mounting bracket (8) is entirely made of tape. The mounting bracket (8) in the second variant consists of the soft fixing base (37), retaining tape (38) and the securing tab (39) covered in a loop fabric (41). The soft fixing base (37), retaining tape (38) and securing tab (39) are made of polyamide tape. The retaining tape (38) of the length shorter than the length of the base (37) is sewn on one end of the soft fixing base (37), thus, it is possible to sew the other end of the soft fixing base (37) of the securing tab (39) so that it will be possible to arrange sequentially from the bottom upwards: the fixing base (37), retaining tape (38) and securing tab (39). The end of the retaining tape (38) is covered on both sides with Velcro hook fabric (40) and a loop fabric (41) is sewn on the upper surface of the base (37) and on the bottom surface of securing tab (39) forming detachable connection of the retaining tape (38) and the fixing base (37). An additional protection against accidental releasing of the detachable connection of the retaining tape (38) and the soft fixing base (37) is the end of the retaining tape (38) covered with the hook fabric (40) and the securing tab (39). A loop fabric (41)

is sewn on the bottom surface of the securing tab (39), while a hook fabric is sewn on the top surface of the retaining tape (38) forming detachable connection of the retaining tape (38) and the securing tab (39). The retaining tape (38) and the soft fixing base (37) are sewn at an appropriate place with the locking stitch (42). The distance between the locking stitch (42) and the loop fabric (41) of the base (37) is selected in such a way so that excessive lateral movement of the central rail (3) is limited.

The retaining tape (38) is locked in its closed position by connecting the hook fabric (40) sewn on the bottom surface of the retaining tape (38) with the loop fabric (41) sewn to the base (37), and then covering the hook fabric sewn on the top surface of the retaining tape (38) with the securing tab (39) and sticking together the hook fabric (40) with the loop fabric (41) of the securing tab (39). The retaining tape (38) is unlocked to its open position by pulling apart the loop fabric (41) of the securing tab (39) and then releasing the hook fabric (40) sewn on the bottom surface of the retaining tape (38) from the loop fabric (41) of the base (37).

The installation of the mounting bracket (8) on the central rail (3) consists in unlocking the retaining tape (38) to its open position, inserting the retaining tape (38) into the through opening (20), and then locking the retaining tape (38) in its closed position.

The width of the retaining tape (38) is selected so that two retaining tapes (38) of mounting brackets (8) turned around the central rail (3) by 180° can be installed in the through opening (20) of the central rail (3) at the same time. In this embodiment the width of the retaining tape (38) is 20 mm.

The width of the retaining tape (38) is less than the width of the through opening (20). This allows the retaining tape (38) to move inside the through opening (20) in longitudinal direction of the central rail (3). Such movement is desired and thanks to it the central rail (3) still remains flexible and adheres well to the diver's body after a lot of mounting brackets (8) are installed on it.

According to the second embodiment all mounting brackets (8) are connected to other harness components with locking stitch (44) and stitches connecting the retaining tape (38) and the securing tab (39) with the soft fixing base (37).

LIST OF DESIGNATIONS

1. Upper junction
2. Lower junction
3. Central rail
3*a*. Central rail top layer
3*b*. Central rail bottom layer
4. Shoulder straps
4*a*. Left shoulder strap
4*b*. Right shoulder strap
5. Hip belt
5*a*. Hip belt left side
5*b*. Hip belt right side
6. Crotch strap
7. Buckle
8. Mounting bracket
9. Bottom padding
10. Stitches connecting the central rail with the upper junction
11. Shoulder strap connections
12. Hip belt connections
13. Crotch strap connections
14. Adjusters
15. Top padding
16*a*. Left stitches
16*b*. Right stitches
17. Limiter
18. Connector
18*a*. Connector upper opening
18*b*. Connector lower opening
19. Locking stitches
20. Through opening
21. Central weight pocket
22. Central weight pocket base
22*a*. Central weight pocket bottom side
23. Weight pockets
24. Latches
25. Weight pocket loop fabric
26. Closure hook fabric
27. Accessory handle
28. Holder
29. Grasping member
30. Holder openings
31. Flashlights battery canister
32. Argon cylinder
33. Fixing base
33*a*. First latch
33*b*. Second latch
34. Spring
34*a*. Spring side
34. Spring arms
35. First latch through opening
36. Second latch through opening
36. Fixing stitches
37. Soft fixing base
38. Retaining tape
39. Securing tab
40. Hook fabric
41. Loop fabric
42. Locking stitch

What is claimed is:

1. A diving harness comprising an upper junction (1) connected through a central rail (3) and shoulder straps (4) to a lower junction (2) connected to a hip belt (5) and a crotch strap (6) tied with a buckle (7), characterized in that the upper junction (1) is permanently connected to the central rail (3) comprising at least two fabric tapes (3*a*, 3*b*) sewn together with locking stitches (19) at regular spacing, forming pass-through sockets (20) between tape layers, whereas the lower junction (2) is permanently connected at least to one mounting bracket (8) detachably connected by a pass-through socket (20) with the central rail (3), wherein the diving harness comprises a accessory handle (27), containing a bracket (28) connected to a grasping member (29), permanently connected to the at least one mounting bracket (8) detachably connected by the pass-through sockets (20) to the central rail (3), wherein the mounting bracket (8) comprises a fixing base (33) provided with a first latch (33*a*) with a pass-through socket (35*a*) and a second latch (33*b*) with a through opening (35*b*) and a spring (34) inserted into the pass-through socket (20) of the central rail (3) with a side (34*a*) installed in the pass-through socket (35*a*) of the first latch (33*a*) and arms (34*b*) are detachably connected in a pass-through socket (35*b*) of the second latch (33*b*).

2. The diving harness according to claim 1, characterized in that the diving harness contains a central weight pocket (21) permanently connected to at least two mounting brackets (8), positioned in relation to each other in spacing corresponding to location of the pass-through sockets (20) detachably connected by the pass-through sockets (20) to the central rail (3).

3. The diving harness according to claim 1 characterized in that the bracket (28) has a shape of an angle section.

4. The diving harness according to claim 1 characterized in that the bracket (28) is made of a material allowing the bracket (28) to be sewn on other harness components.

5. The diving harness according to claim 1 characterized in that the fixing base (33) is made of a material allowing the fixing base (33) to be sewn on other harness components.

6. The diving harness according to claim 1 characterized in that the soft fixing base (37) is made of a material allowing the soft fixing base (37) to be sewn on other harness components.

7. The diving harness according to claim 1 characterized in that the mounting bracket (8) comprises a soft fixing base (37), a securing tab (39) and a retaining tape (38) inserted into the through opening (20) of the central rail (3), wherein a soft fixing base (37) at its one end is permanently connected to a retaining tape (38) and at the other end it is permanently connected to a securing tab (39) and a bottom surface of the retaining tape (38) is detachably connected to the top surface of the base (37), while the bottom surface of the securing tab (39) is detachably connected to a top surface of the retaining tape (38).

* * * * *